United States Patent [19]

Sabatino

[11] Patent Number: 4,685,511

[45] Date of Patent: Aug. 11, 1987

[54] TUBE SUPPORT FOR MOISTURE SEPARATOR REHEATER

[75] Inventor: Raymond A. Sabatino, Havertown, Pa.

[73] Assignee: Westinghouse Electric Corp., Pittsburgh, Pa.

[21] Appl. No.: 785,379

[22] Filed: Oct. 8, 1985

[51] Int. Cl.[4] ..... F28F 7/00

[52] U.S. Cl. ..... 165/82; 165/162; 122/483

[58] Field of Search ..... 165/82, 162; 122/483

[56] References Cited

U.S. PATENT DOCUMENTS

| | | | |
|---|---|---|---|
| 2,876,975 | 3/1959 | Short | 165/82 X |
| 3,020,024 | 2/1962 | Lawrance | 165/82 X |
| 3,446,938 | 5/1969 | Morgan | 165/82 X |
| 3,896,874 | 7/1975 | Borgaard et al. | 165/82 |
| 4,166,497 | 9/1979 | Coit | 165/111 |
| 4,450,902 | 5/1984 | Bosne | 165/82 |

*Primary Examiner*—Albert W. Davis, Jr.
*Assistant Examiner*—Peggy A. Neils
*Attorney, Agent, or Firm*—Daniel C. Abeles

[57] ABSTRACT

A tube support for U-shaped tubes of a moisture separator reheater is disclosed. The tube supports in the proximity of U-bend of the U-shaped tubes being divided into an upper movable tube support member and a lower immovable tube support member, whereby the U-shaped tube members are permitted to expand without binding.

4 Claims, 8 Drawing Figures

TUBE SUPPORT FOR MOISTURE SEPARATOR REHEATER

BACKGROUND OF THE INVENTION

This invention relates to moisture separator reheaters for nuclear power plants and, in particular, to a moisture separator reheater having a heat exchanger comprising a plurality of U-shaped tubes. Such moisture separator reheaters are well known in the art and are typically used between a high-pressure steam turbine and a low-pressure steam turbine in a nuclear power plant. The U-shaped tubes are typically supported by immovable tube supports which sometimes cause the tubes to bind at the edges of the tube support apertures due to thermal expansion.

SUMMARY OF THE INVENTION

The present invention provides a moisture separator reheater for a nuclear steam generating power plant. The reheater typically comprises a sealed elongated substantially horizontal tubular shell member. A cycle fluid inlet passes through the shell member in predetermined position. A moisture separator means is positioned within the shell member proximate the bottom portion thereof. Heat exchanger means comprises a plurality of elongated metallic U-shaped members disposed within said shell member. A tube support member means is provided in supportive relationship with the tube members. The U-shaped tube members each have a top leg portion, a U-bend portion and a bottom leg portion. The top leg portion and the bottom leg portion are positioned substantially horizontally within the shell member.

The tube support member means has aperture means therethrough. Each of the bottom leg portions and the top leg portions of the U-shaped tube members pass through the aperture means and are supported by the tube support member means. A dome-shaped head member is affixed to a first side of a first of said tube support member means in sealing relationship therewith forming a chamber therein. A partition means is typically disposed within the chamber and divides the head member into a lower chamber and an upper chamber. The head member has a heating fluid inlet passing therethrough into the upper chamber.

The improvement comprises the tube support member means proximate the U-bend portion of the U-shaped tubes each comprising an upper movable tube support member and a lower immovable tube support member, the remaining tube support member means being immovable for both upper and lower legs. The upper movable tube support member has the top leg portions of the U-tube members passing therethrough and the lower immovable tube support member has the bottom leg portions of the U-shaped tube members passing therethrough. Utilizing the present invention, the top leg portions of the U-shaped tube members which experience thermal expansion away from the bottom leg portions are permitted to move freely in both the vertical and axial directions.

In another embodiment where the heating fluid enters the lower chamber of the head member initially, the tube support member means is provided with the same upper movable tube support member to provide for the same thermal expansion of the top leg portions away from the bottom leg portions of the U-shaped tube member which experience the greatest thermal expansion near the U-bend portion.

BRIEF DESCRIPTION OF THE DRAWINGS

For a better understanding of the invention, reference may be had to the accompanying drawings, in which.

DESCRIPTION OF THE PREFERRED EMBODIMENTS

Figure 1:
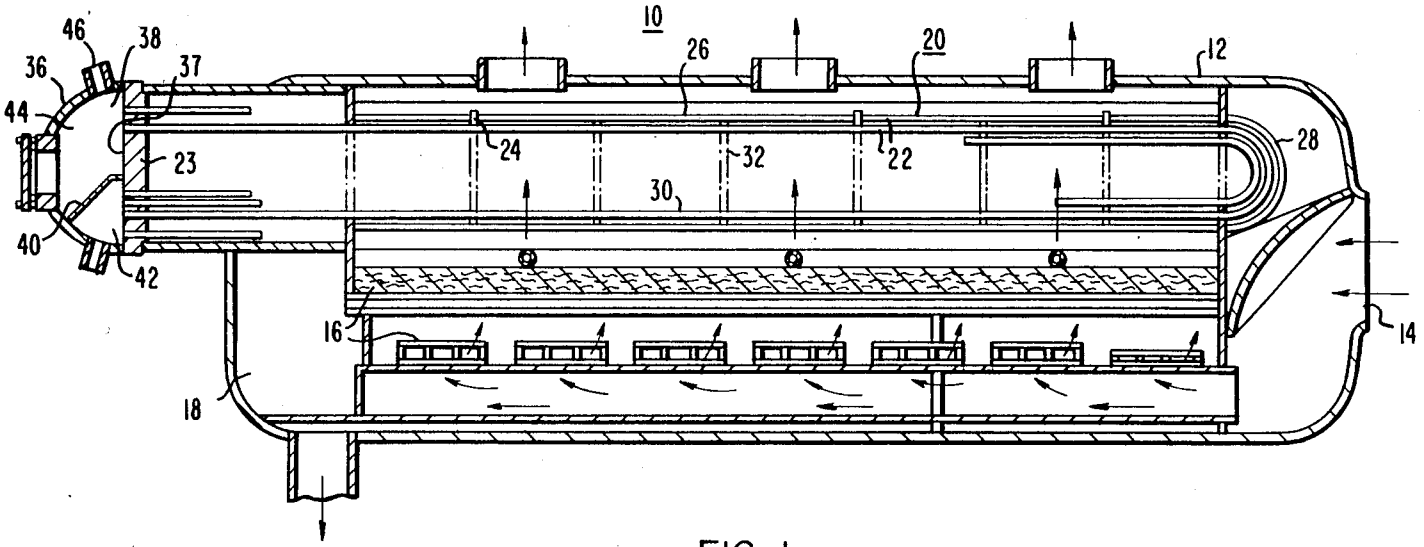
FIG. 1 is an elevational cross-sectional view of a typical moisture separator reheater.

Referring to FIG. 1, there is provided a moisture separator reheater 10 for a nuclear steam generating power plant, not shown. The reheater 10 comprises a sealed elongated substantially horizontal tubular shell member means 12. A cycle fluid inlet 14 passes through the shell member 12 in predetermined position such as shown in FIG. 1. The cycle fluid, as stated previously, typically comprises steam with entrained moisture exhausted from a high-pressure steam turbine. A moisture separator means 16 is provided as is known in the art and may be a chevron-type structure or mesh pad structure, for example. Moisture separator means is typically positioned within the shell member 12 proximate the bottom portion 18 thereof. Heat exchanger means 20 is provided. The heat exchanger means 20 comprises comprises a plurality of elongated U-shaped tube members 22 disposed substantially within the shell member 12. A tube support member means 24 is in supportive relationship with the tube members 22. The U-shaped tube members each have a top leg portion 26, a U-bend portion 28 and a bottom leg portion 30. The top leg portion 26 and the bottom leg portion 30 are positioned substantially horizontally within the shell member 12.

Figure 3:
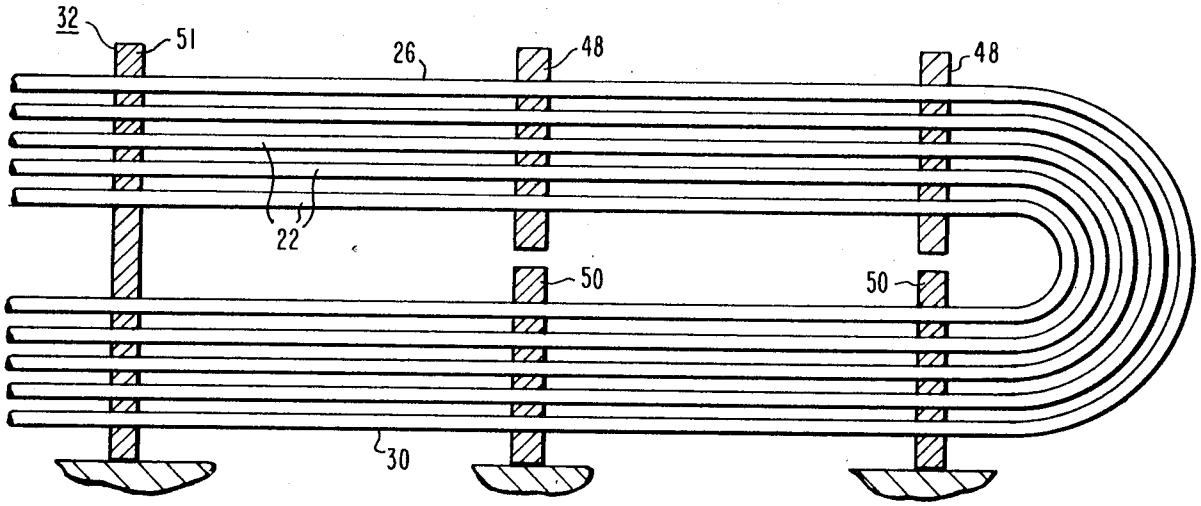
FIG. 3 is an enlarged elevational view of one end of the U-tube members proximate the U-bend portion showing the tube supports of the present invention.
Figure 4A:
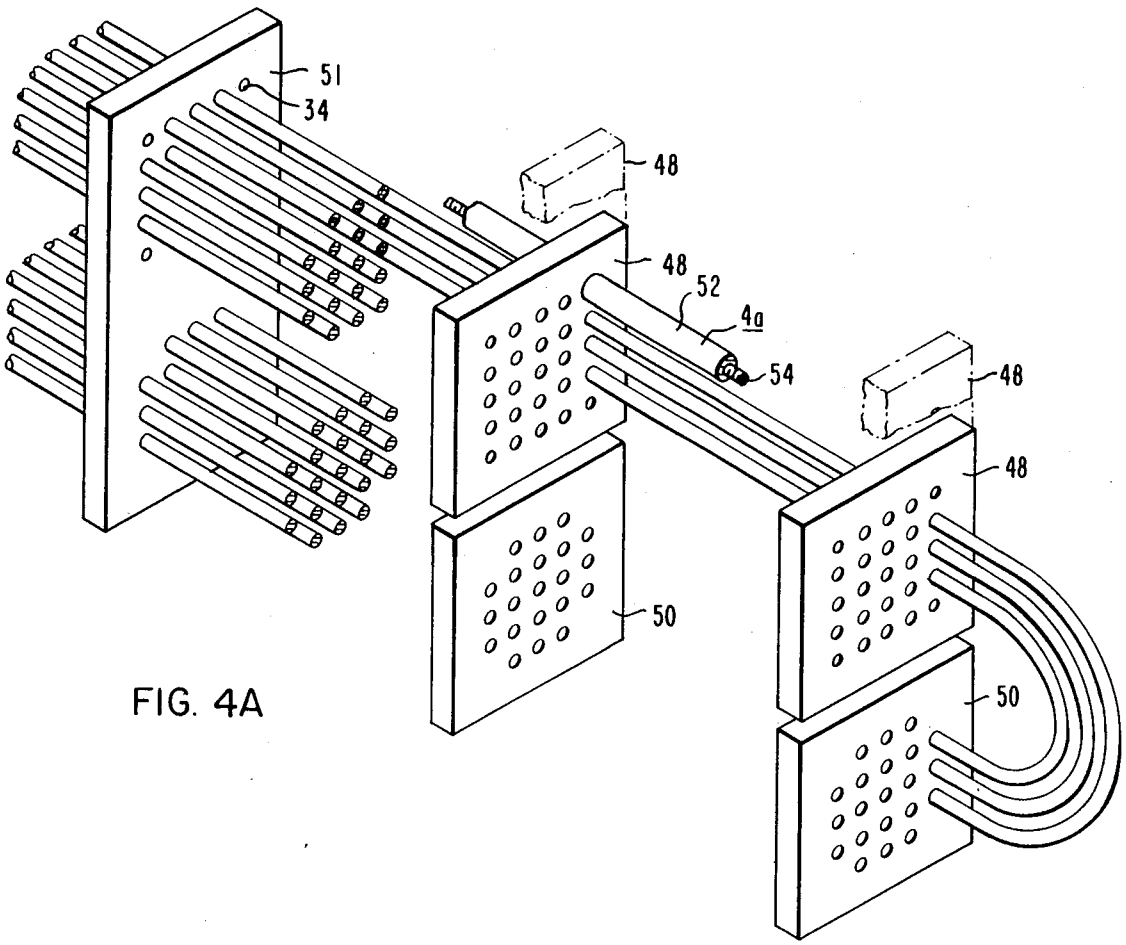
FIG. 4A is a schematic isometric view of the tube supports of the present invention in the area of the U-bend portion showing the freedom of movement of the upper movable tube supports.

The tube support member means 32 has aperture means 34 therethrough. Each of the bottom leg portions 30 and the top leg portions 26 of the U-shaped tube members 22 pass through the aperture means 34 and is supported and spaced relative to one another by the tube support means 32 as shown in FIGS. 3 and 4*a*.

A dome-shaped head member 36 is affixed to a first side 38 of the tube sheet member 23 in sealing relationship therewith forming a chamber 38 therein. A partition means 40 is typically disposed within said chamber 38 and divides the chamber 38 into a lower chamber 42 and upper chamber 44. The head member 36 has a heating fluid inlet 46 therethrough into the upper chamber 44.

The improvement comprises the tube support member means 32 proximate the U-bend portion 28 of the U-shaped tubes 22 comprising an upper movable tube support member 48 and a lower immovable tube support member 50. The remainder 51 of the tube support means 52 is immovable. The upper movable tube support member 48 spaces and supports the top leg portions 26 of the U-shaped tube members 22. The lower immovable tube support member 50 spaces and supports the bottom leg portions 30 of the U-shaped tube members 22. Utilizing the present invention, the top leg portions 26 of the U-shaped tube members are permitted to move along with the upper movable tube support members 48 to compensate for thermal expansion of the U-tube members.

Figure 2A:
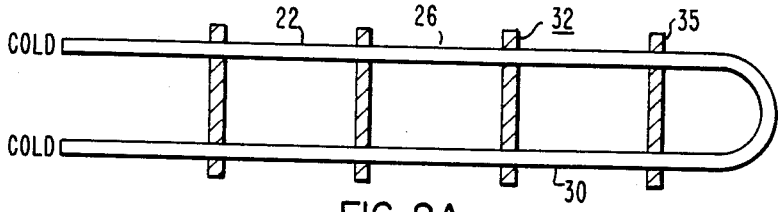
FIG. 2A is a schematic of the U-shaped tube members in the "cold" state.
Figure 2B:
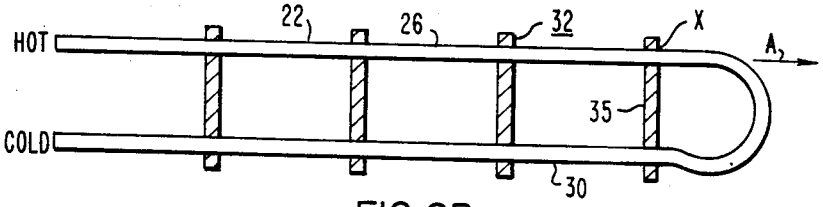
FIG. 2B is a schematic of the U-shaped tube members of the prior art showing the deformation and some binding at point K at the U-bend portion when the top leg portion is hot.
Figure 2C:
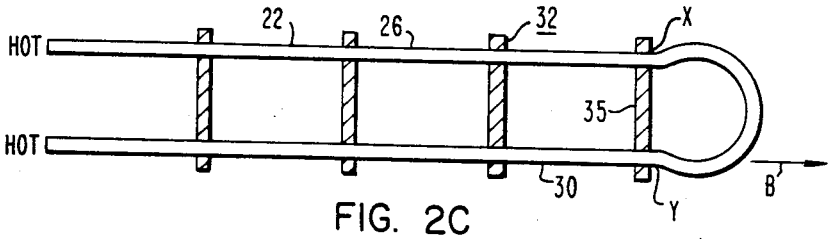
FIG. 2C is a schematic of the U-shaped tube member of the prior art showing the deformation of the U-bend portion and increased bending at points X and Y when both the top leg and bottom leg portions are hot.

With the heating fluid inlet opening into the upper chambers the top leg portions 26 of the U-shaped tube members during start-up become hot before the bottom leg portions 30 of the U-shaped tube members as shown in FIG. 2B. The top leg portion 26 expands and the tube expansion is guided by the immovable tube support 35 of the prior art. The tube 22 expands in the direction of the arrow "A". The movement and deformation of the top leg portions of the U-shaped tube members 22 causes a bearing force at point "X" which may lead to tube wear, tube looseness, vibration and tube failure. Eventually, the temperature becomes uniform and the bottom leg portion 30 of the U-shaped tube members 22 expands in the direction of arrow "B" in FIG. 2B. However, because of the higher temperature, the radius of the U-bend portion becomes still larger, but the fixed tube supports 35 of the prior art restrain any increase in radius. This results in increase of the bearing forces at points X and Y which tend to cause wear, looseness, vibration and U-shape tube member failure.

Figure 2D:
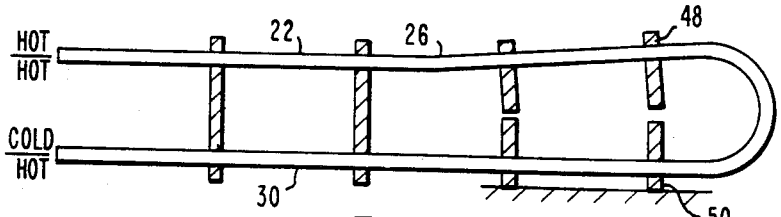
FIG. 2D is a schematic of the U-shaped tube members, the deformation of U-shaped tube members utilizing the movable and immovable tube supports of the present invention.
Figure 4B:
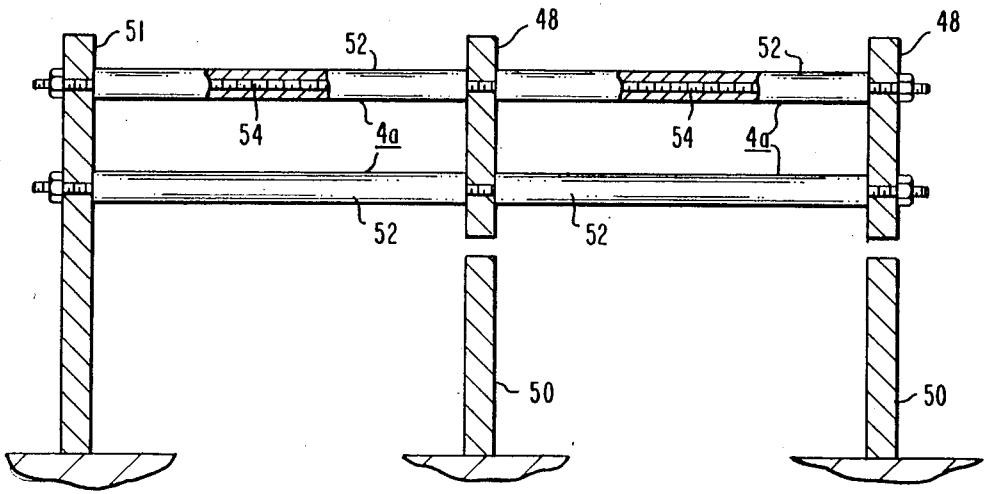
FIG. 4B is a side elevational view showing the stay rod means in supportive relationship with the upper movable supports.

The present invention provides for the last one, two or more tube support member means 32 being divided in two halves, the upper movable tube support member 48 and the lower immovable tube support member 50. Any movement by the U-shaped tube members 22 will raise or lower the upper movable tube supports 48, thus minimizing the interaction of forces between the tube support 32 and the U-shaped tube members and greatly reducing the possibility of wear, looseness, vibration and failure as shown in FIG. 2D and FIG. 3. The upper movable tube support members 48 are held in position by stay rod means 4*a* comprising four or more pipe spacers 52 and stay rods 54 as shown in FIGS. 4A and 4B which connect to the next movable tube support 48, etc. until a movable support 48 is held in position by a continuation of the same stay rods connected to the upper half of an immovable support 50.

Typically, the spacer 52 is $\frac{1}{2}''$ pipe and the stay rod 54 is $\frac{1}{2}''$ and passes through spacer 52. Tightening the nuts on both ends of the rod "anchors" the movable supports to the last full fixed tube support.

The present invention may also be utilized with a four-pass system such as disclosed in U.S. Pat. No. 4,166,497 dated Sept. 4, 1979 to Coit without modification. If the heating fluid is introduced into the lower chamber instead of the upper chamber, the upper halves of the tube support members proximate the U-bend should still be made movable and the lower halves made immovable.

What is claimed is:

1. In combination with a moisture separator reheater for a nuclear steam generating power plant, said reheater comprising:

a sealed elongated substantially horizontal tubular shell member, a cycle fluid inlet passing through said shell member in predetermined position, moisture separator means positioned within said shell member proximate the bottom portion thereof, heat exhanger means comprising a plurality of elongated metallic U-shaped members disposed substantially within said shell member, a tube sheet member supporting said U-shaped tube members at one end thereof, a tube support member means in supportive relationship with said tube members, the U-shaped tube members each having a top leg portion, a U-bend portion and a bottom leg portion, said top leg portion and said bottom leg portion positioned substantially horizontally within said shell member, said tube support member means having aperture means therethrough, each of said bottom leg portions and said top leg portions of said U-shaped tube members passing through said aperture means and supported by said tube support member means, a dome-shaped head member affixed to a first side of said tube sheet member in sealing relationship therewith forming a chamber therein, a partition means disposed within said chamber and dividing said chamber into a lower chamber and an upper chamber, said head member having a heating fluid inlet passing therethrough the improvement which comprises: said tube support member means proximate said U-bend portion of said U-shaped tube members each comprising an upper movable tube support member and a lower immovable tube support member, the remainder of said tube support means being immovable, said upper movable tube support member spacing and supporting said top leg portions of said U-shaped tube members, said lower immovable tube support member spacing and supporting said bottom leg portions of said U-shaped tube members, whereby the top leg portions of the U-shaped tube members proximate said U-bend are permitted to move to compensate for any increase in radius in the U-bend portion of the U-shaped tube member due to thermal expansion.

2. The reheater of claim 1, wherein said heating fluid inlet passes through said head member into said upper chamber.

3. The reheater of claim 1, wherein said heating fluid inlet passes through said head member into said lower chamber.

4. The reheater of claim 1, further comprising stay rod means for supporting said upper movable support member, said stay rod means affixed to one of said remaining immovable tube support members.

* * * * *